US006103516A

United States Patent [19]

Reverso

[11] Patent Number: 6,103,516

[45] Date of Patent: Aug. 15, 2000

[54] BIOCHEMICAL METHOD FOR EXTRACTING OILS FROM SEEDS AND CARYOPSIDES OF OLEAGINOUS PLANTS

[76] Inventor: Riccardo Reverso, Via Mazzoni, 4, 15100 Alessandria, Italy

[21] Appl. No.: 09/231,294

[22] Filed: Jan. 15, 1999

[30] Foreign Application Priority Data

Jan. 20, 1998 [IT] Italy ..... MI98A0093

[51] Int. Cl.[7] ..... C11C 1/00

[52] U.S. Cl. ..... 435/271; 127/34; 127/67

[58] Field of Search ..... 435/271; 127/34, 127/65, 67

[56] References Cited

PUBLICATIONS (Abstract) Badr, F.H. et al., "Optimizing conditions for enzymatic extraction of sunflower oil". Grasas y Aceites, vol. 43, No. 5, pp. 281–283, 1992.

*Primary Examiner*—David A. Redding
*Attorney, Agent, or Firm*—Guido Modiano; Albert Josif; Daniel O'Byrne

[57] ABSTRACT

A method for extracting vegetable oils from oleaginous plants in which the solid parts of the plants, which contain oils embedded in macromolecular polysaccharide substances typical of the integument of the plants, are subjected to an enzyme attack by means of at least one enzyme which lyses at least that polysaccharide. Then the oil contained in the solid parts is recovered by means of conventional mechanical recovery stages without using a solvent-based extraction stage.

13 Claims, 1 Drawing Sheet

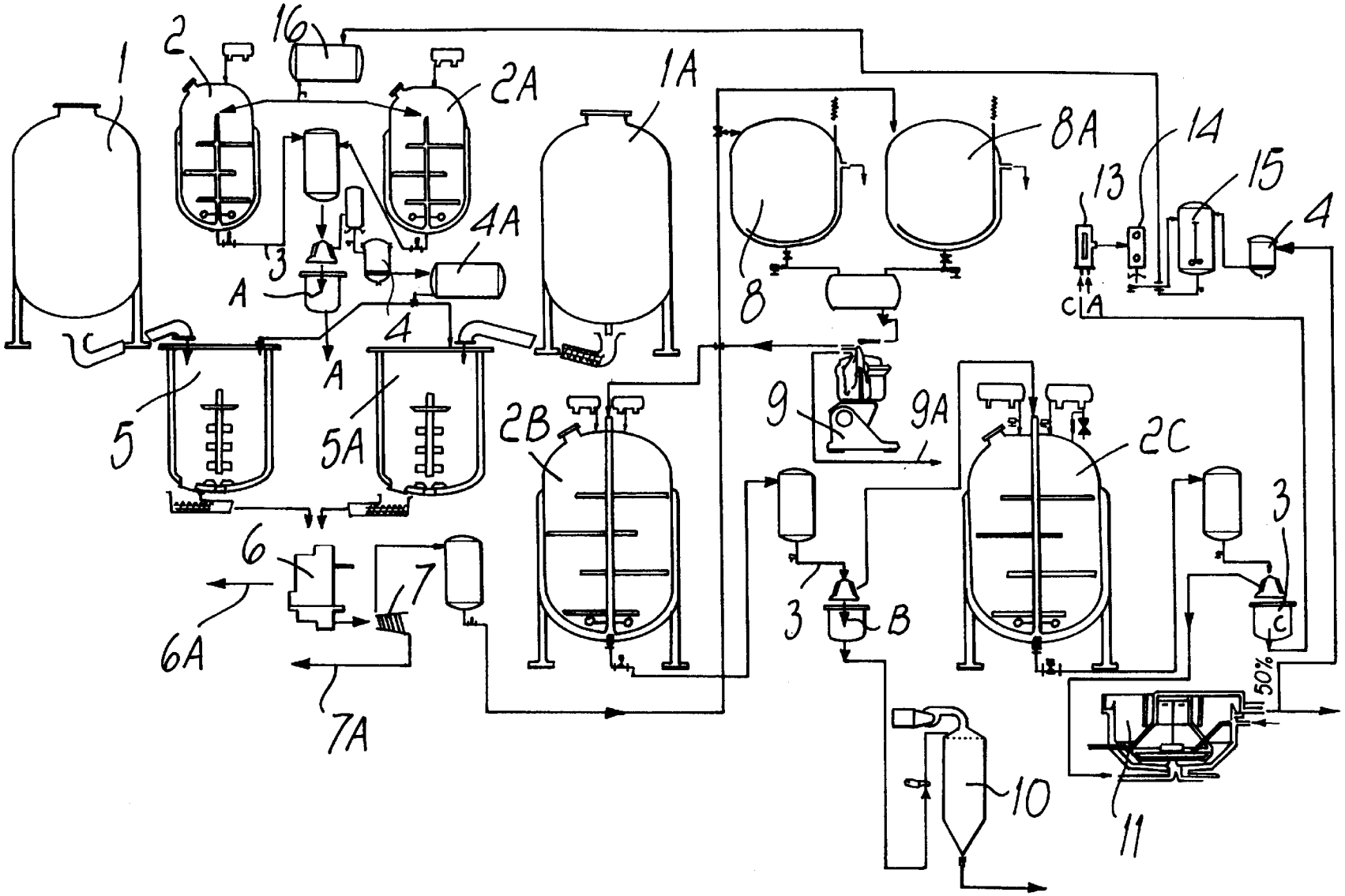
1
2
2A
2B
2C
3
4
4A
5
5A
6
6A
7
7A
8
8A
9
9A
10
11
13
14
15
16
A
B
C
CA
50%

BIOCHEMICAL METHOD FOR EXTRACTING OILS FROM SEEDS AND CARYOPSIDES OF OLEAGINOUS PLANTS

BACKGROUND OF THE INVENTION

The present invention relates to a method for extracting vegetable oils from oleaginous plants.

The methods currently used to extract vegetable oils entail the use of solvents both during primary extraction processes, in the case of seeds or caryopsides of oleaginous plants which do not release the oil contained therein by simple pressing (for example cotton, maize, soya, rape etcetera) and, in the case of oleaginous plants which can be pressed, such as olives, sunflowers and peanuts, during the secondary step for the extraction of oil from the plant residues that remain after pressing.

Oleaginous seeds generally contain the lipids to be extracted in the internal cytosol, which is enclosed externally by the cuticle with its integument constituted by macromolecules.

Research conducted on the various protective integuments allows to say that said integuments are usually constituted by sugary polymers and particularly by the following polysaccharides: hemicelluloses, celluloses, inulins, starches and pectins. These polymers are in turn accompanied by a waxy cuticle which is constituted by saponins and phospholipids; ligneous seeds are of course an exception.

The mechanism by which the solvent is able to extract the oil from the cytosol is due to a factor related to osmosis and to the dissolution of saponins and phospholipids, so that the solvent creates a breach in the integument through which it flows into the cytosol.

The use of solvents certainly entails evident disadvantages, especially from the point of view of the possible risks for human health, particularly in the case of combustible oils for food use.

SUMMARY OF THE INVENTION

The aim of the present invention is to obviate the drawbacks of current systems for extracting vegetable oils based on the use of solvents, particularly of those performed on an industrial scale.

Accordingly, an object of the present invention is to provide a process for extracting oils from oleaginous plants which does not require the use of solvents although it allows to achieve a high extraction yield.

Another object of the invention is to provide a process for extracting vegetable oils which is economically convenient and advantageous from the environmental point of view thanks to the conditioning and recycling of the residues and byproducts generated by the process.

This aim, these objects and others which will become apparent hereinafter are achieved by a method for extracting oils from oleaginous plants or residues thereof, according to the invention, characterized in that it comprises the stages of subjecting the solid parts of said plants, which contain oils embedded in macromolecular polysaccharide substances typical of the integument of said plants, to an enzyme attack by means of at least one enzyme which lyses at least one said polysaccharide, and in then recovering the oil from said solid parts by means of conventional mechanical recovery stages without the use of solvent-based extraction.

The method according to the invention is conveniently based on targeted biochemical attacks performed with enzymes in order to release the oil from the cytosol of the seeds or caryopsides of oleaginous plants no longer by means of an osmotic and physical dissolution effect but by breaking up the saccharide polymers that are present in the external integument of seeds or caryopsides. The same method can also be applied to recover "second pressing" oil from the residues of the first pressing in the case of plants which release oil directly and already during pressing, such as olives, sunflowers or peanuts, for example from olive pomace.

In olive pomace it has been observed that the residual oil from first pressing is embedded in a mucilage the maximum percentage of which is constituted by hemicellulose and pectins, although inulin is also present; accordingly, for this particular environment it is necessary to break up at least two polymeric components: hemicellulose and pectin.

For other seeds which do not lose oil during pressing, such as soya, maize, etcetera, a single enzyme is sufficient to breach the integument and open a path toward the cytosol, from which oil then flows by subsequent pressing.

In any case, it must be noted that in the integument of the seeds or caryopsides of the different oleaginous plants there can be differences in chemical composition due to the type of soil or to the climate in which the plant has been grown. Accordingly, it is convenient to determine in each case which, among the polysaccharide polymers usually present as main components in the integument, i.e., hemicelluloses, celluloses, inulins, starches and pectins, is or are the primary component or components, so as to determine the most convenient type of enzyme or enzymes to use in the process according to the present invention. This is achieved by means of an enzyme kinetics analysis performed with conventional methods, as described for example in "A flexible system of enzymatic analysis" by Oliver H. Lowery and Janet V. Passoneau (Academic Press); "Initial rate enzyme Kinetic Springer" by H. J. Fromm; "Kinetics of enzyme mechanism" by J. T. F. Wong (Academic Press), etcetera, according to which the amounts of cellulose and/or pectin and/or starch are investigated.

The enzymes usable as a function of the polysaccharides that are present as primary components are advantageously selected from the three groups constituted by alpha-amylases with predominant starch and inulin lysis activity; by pectic lyases, such as pectic acid transeliminases, for example pectin methyl trans-eliminase or polygalacturonate trans-eliminase with predominant pectin and hemicellulose lysis activity; and by cellulases, for example endo-1, 4-beta-glucanase, with cellulose lysis activity.

The enzyme treatment according to the method of the present invention is performable by using pure ready-made enzymes which are commercially available as such. However, due to the costs related to the use of pure enzymes, it is preferable to use enzymes prepared locally in the method according to the invention by culturing microorganisms on suitable nutrient substrates, for example culture broths. Enzyme-producing microorganisms can be chosen among bacteria, fungi and hyphomycetes. An exemplifying and nonlimitative list of these microorganisms, known to produce enzymes which are useful in the method according to the present invention, is given hereafter. The filing numbers (or identification codes) of the respective strains at the American Type Culture Collection (ATCC, Rockville, Md, U.S.A.) are also listed in brackets.

A) ALPHA-AMYLASE PRODUCTION

A.1) BACTERIA

*Bacillus cereus* (ATCC codes 21768 and 21769 and 21771 and 21772): produces alpha-amylase;

*Bacillus subtilis* (ATCC code 21556): produces alphaamylase and protease;

*Bacillus subtilis* (ATCC code 21770): produces alphaamylase;

A.2) FUNGI

*Aspergillus foetidus* (ATCC code 10254): produces alphaamylase, amyloglucosidase, esterase and lipase;

*Aspergillus horizae* (ATCC code 11601): produces alphaamylase;

*Cladosporium resinae* (ATCC code 20495): produces alpha-D-glucosidase, alpha-amylase and glucoamylase;

*Cryptococcus luteoleus* (ATCC code 44440): produces alpha-amylase;

*Filobasidium capsoligenum* (ATCC codes 14437 and 21180 and 44444): produce alpha-amylase and glucan-1,4-alpha-glucosidase;

A.3) HYPHOMYCETES

*Lipomyces conoenkoae* (ATCC code 44833): utilizes starch directly and produces extracellular alpha-amylase and glucoamylase;

*Lipomyces conoenkoae* (ATCC code 44837): produces alphaamylase;

*Saccharomycopsis capsularis* (ATCC code 4441): produces alpha-amylase;

*Saccharomycopsis fibuligera* (ATCC code 9947): produces glucoamylase, alpha-amylase and biomass from potato starch;

*Schwanniomyces occidentalis* (ATCC codes 44442 and 44443): produces alpha-amylase;

B) PECTIN LYASE PRODUCTION

B.1) BACTERIA

*Bacillus polymixa* (ATCC code 21551: produces polygalactouronate trans-eliminase;

B.2) FUNGI

*Colletrichum lindemuthianum* (ATCC code 56987): produces pectin lyase;

*Aspergillus japonicus* (ATCC code 20236): produces pectin trans-eliminase and hydroxycinnamic acid;

*Monilinia fructigena* (ATCC code 26106): produces pectin lyase, acid protease, alpha-levo-arabinofuranosidase;

*Penicillium expansum* (ATCC code 24692): produces pectin lyase and cellulase.

C) CELLULASE PRODUCTION

C.1) BACTERIA

Cellulomonas Sp (ATCC code 21399): produces extracellular cellulose;

*Clostridium thermocellum* (ATCC code 27405): produces cellulase;

*Thermomonospora fusca* (ATCC code 27730): produces active cellulase and carboxymethyl cellulose;

(unidentified Bacterium) (ATCC code 31085): produces cellulase and endocellulase.

Among enzyme-producing microorganisms, preference is given to the use of sporogenous bacteria for two separate reasons:

hyphomycetes and fungi are usually microorganisms which are capable of many enzyme activities and are subject to heterokaryosis, which can lead to substantial changes to their nutrition pattern, accordingly creating enzyme activities which can modify or alter the protein and the lipid extracted;

by using sporogenous bacteria, lysis, which can be performed if the retention times are longer than the crest of the growth curve, is eliminated by means of their particular intrinsic adaptation; in fact they do not lyse but become spores and accordingly they do not release their genetic material, including lipase and protease enzymes.

In the case of enzymes produced locally, the chosen microorganism or microorganisms is or are seeded on a nutrient substrate, for example a culture broth having a selected composition. In the case of bacteria it is possible to select the composition of the substrate so as to induce the production of a given enzyme and conversely inhibit the production of others by means of the adaptive abilities of bacteria.

The microorganisms are then cultured for the time required to reach their maximum growth factor, after which the culture broth that contains the produced enzymes is separated, for example by centrifugation and/or filtration on a membrane, and is added to the solid oleaginous parts to be processed after mixing them with water so as to form a fluid paste or a suspension.

In the process according to the invention the enzyme or enzymes are used at a concentration preferably of 0.5 to 10 mg/kg of solid mass to be treated. Treatment with enzymes is performed at temperatures which are preferably well below enzyme inactivation values. Preferably, the process is conducted at temperatures between room temperature and approximately 35° C.±2° C. under agitation at a pH which advantageously varies in the range between 5.5 and 7.8 according to the specific enzymes used.

The enzyme treatment stage conveniently requires rather short times for hydrolytic breakdown, usually 1–2 minutes. After this stage, the oil contained in the solid parts thus treated is separated with conventional mechanical means, for example by centrifugation in the case of a secondary extraction process, for example from olive pomace, or by pressing and subsequent centrifugations in the case of primary extraction from seeds or caryopsides. In all cases, after separation from the solid residues of the oleaginous plants, which can be used for example in the production of fertilizers, the oil is separated from the process wastewater by means of a conventional centrifugation stage and is then subjected to final refining.

Advantageously, the process wastewater is recycled after conditioning for example by metabolization of said wastewater with hyphomycetes, producing biomasses which can be used, together with the biomasses produced by the local production of enzymes, in preparing the nutrient substrate to be fed to the culture of the microorganisms that produce said enzymes. In this manner, in addition to conditioning the process wastewater to be discharged, which is required from an environmental point of view, a valid substitute of the substrate or nutrient broth is obtained as a replacement of commercially available broths formulated with yeast and meat extracts, consequently achieving a considerable saving from an economical point of view.

The nonlimitative examples that follow are some possible embodiments of the method according to the invention.

BRIEF DESCRIPTION OF THE DRAWINGS.

The FIGURE shown in the accompanying drawing is the flowchart of the embodiment of the process of the invention exemplified in Example 2.

DESCRIPTION OF THE PREFERRED EMBODIMENTS.

Example 1

This example illustrates the secondary extraction of oil from olive pomace by using pure ready-made enzymes.

1) the pomace is fed into a paste mixer and receives the addition of 35–40% by weight of recycled wastewater from the region where second centrifugation is performed after flushing the oil;

2) the pH is corrected to 6±2 by means of ammonium hydrate with 10% insertion of alpha-amylase in the amount of 4 microorganisms per liter of mass to be treated; the mass is kept under agitation at a temperature of 25° C.±2°0 C. for 4–5 minutes. The enzyme is solubilized in a sodium acetate solution at pH 6 and introduced in the mixer.

3) the temperature is raised to 35° C.±2° C. and 0.2 mg of Bromelin 2M Auson (trade name of pectic acid trans-eliminase, available from E. Merck, Darmstadt, Germany), solubilized in 0.1 molar ammonium citrate, are added; agitation is performed for 4–5 minutes.

4) the pH is corrected to 4.8±0.1 in two steps:

from pH 6 to pH 5.2 with $H_2SO_4$ in a 20% aqueous solution;

from pH 5.2 to pH 4.8 with a 20% aqueous solution of acetic acid.

Then the temperature is brought to 30° C. and a solution of cellulase (endo-1,4-beta-glucanase) in an amount of 5 mg/l in 0.1 molar ammonium acetate is added, and the system is agitated for 10 minutes.

5) Centrifugation is performed with a "Bird" type (a trade mark of Alfa Laval) solid/liquid centrifuge with scraping screw; the recovered solid is sent to fertilizer production, while the liquid, which is constituted by a mixture of water and oil, is sent to subsequent treatments.

6) A subsequent centrifugation with an Alfa Laval liquid/liquid plate centrifuge separates the water from the oil; in particular, the water can be sent to protein production according to a method which is the subject of a parallel patent application filed by the same Applicant; the extracted oil is sent to a fast mixer and receives the addition of lukewarm water (35° C.–40° C.) containing 4% sodium carbonate by weight in order to remove free acidity in the amount of 35–40% by volume/oil. The mix is kept vigorously agitated for 2–3 minutes and then centrifuged; the water recovered from this mix is sent to the head of the plant to recycle it to the preparation of the pomace suspension (step 1 above), while the oil is subjected to the conventional refining and distillation treatments. The recovered oil maintains its characteristics as extra virgin olive oil.

EXAMPLE 2

This example illustrates the primary extraction of oil from soya seeds using enzymes produced locally.

The complete operating cycle with strain 21768 of *Bacillus ceruleus* is described; this cycle is applicable to a type of soya for which enzyme kinetics analysis has shown that the seed integument had a higher concentration of inulin and accordingly it was observed to be advantageous to use the alpha-amylase enzyme. The flowchart of the process is in any case applicable to all the enzymes that can be used with the process according to the invention; reference is made to the accompanying drawing, which illustrates, for the main stages, twin units (designated by the letter A after the reference numeral in the FIGURE) for use in parallel or according to alternating cycles.

A. Preparation of the Enzyme

*Bacillus Cereus* is seeded in a bioreactor (2) equipped with all the control systems for oxidative metabolization; its genome contains the biological memory for producing extracellular alpha-amylase, and it is cultured in the absence of starch on Nutrient Broth by Difco Lab (Detroit, Mich., U.S.A.).

In this case, since the microorganism has no starch available in the culture broth, it pours the enzyme into the bionic medium, which reaches the maximum concentration at its maximum growth (cells/ml of culture broth).

When the microbial mass has reached its maximum growth, the culture broth is partly filtered in order to leave in the reactor the determined inoculum base, which is a mass which oscillates between 1/10 and ½ of the volume according to the retention time chosen at the facility.

Filtration occurs in two steps:

centrifugation with a liquid/solid centrifuge (3) with an accumulation tank for solids (A) which contains most of the cells that are present, which are sent to the preparation of culture broths as described hereinafter;

filtration of the liquid part on a "biological" membrane (4), i.e., on a membrane filter capable of retaining every trace of microorganisms that have escaped centrifugation and which, if left in the medium, as mentioned would alter the lipid or protein.

At this point a clear broth in the tank 4A is obtainable, which contains the enzyme required for inulin breakdown, with optimum resources for biochemical reactions.

B. Enzyme Attack

The broth containing the enzyme produced is poured into the paste mixer (5), in which the soya has been introduced; said soya arrives from a tank (1) and receives the addition of an equal weight of water.

The mass is corrected to a pH between 6 and 6.1 at a temperature of 35±2° C. and is kept agitated.

pH correction must be performed, if the medium is subacid, with 10% ammonium hydrate by weight or, if the medium is subbasic, with 1 molar acetic acid.

Once the temperature and the pH have been stabilized, the enzyme is poured and the system is kept agitated for 1–2 minutes, which is the time required for hydrolytic breakdown.

C. Pressing and Centrifugation

After the enzyme reaction, the resulting mass is pressed with presses (6) of the type normally used in the pressing of olives; this produces a solid cake (6A) and a liquid part which undergo two different treatments:

the solid part (6A) of the pressing is roasted at 110° C. to neutralize the enzyme that is present therein (urease) by means of conventional treatments which are typical of the oil industry and are not shown in the accompanying flowchart;

the liquid part separated by pressing in (6) is centrifuged in a centrifuge of the Bird type (7) in order to separate the liquid part, which contains water, oil and lecithin, from the solid residues, which are sent to drying (7A).

D. Separation of Lecithin and Oil

The liquid separated in (7) is first subjected to separation of the lecithin in (8) by means of bubbled-through steam according to conventional systems. The oil is separated by centrifugation in (9) and is then sent to conventional refining (9A).

E. Metabolization of Process Wastewater

The water that remains after centrifugation in (9) contains D-glycuronic acid and pentasaccharides, which are the products of the breakdown of the inulin performed by the alpha-amylase enzyme. It is appropriately balanced in its C/N/P ratios to 100/5/2 by means of diammonium phosphate and optionally corrected to pH 4.5–4.8 by means of 10% sulfuric acid in solution.

The operations occur in the fermentation reactor (2B), which is equipped with all the controls for aerobic fermentation, and is seeded by a dense culture of:

*Saccharomyces cerevisiae* (ATCC code 24858): ethanol-tolerant and metabolization of hydrolyzed biomasses.

The metabolization of the strain leads to the catabolite ethanol, which accumulates in the bionic medium; once metabolization is complete, the mass is discharged and centrifuged in (3) with a solid accumulation tank (B).

The solid is sent to drying in (10) and is an excellent protein for zootechnical use.

The centrifugation supernatant is sent to a second bioreactor (2C), which is similar to the above bioreactor (2B) in terms of construction and concept and where the inoculation occurs of a dense culture of

*Candida utilis* (ATCC code 26387): uses ethyl alcohol as its sole carbon source.

This microorganism is ethanol-dependent without further balancings or pH variations.

In said biofermentation reactor (2C) all the ethanol is converted into biomass, which is then separated by centrifugation in a solid/liquid machine (3) with a solid accumulation tank (C).

The supernatant is sent to final conditioning on an aeroaccelerator (11); the solid part is sent during the subsequent step for preparing the culture broths.

F. Preparation of the Culture Broths

The biomasses recovered in the centrifugations in (3) (A) and (C) are sent to ultrasound treatment (13) in order to achieve cell lysis thereof. They are then sent to sterilization (14) in an autoclave at 125° C. for 15 minutes and then mixed appropriately and sent to accumulation tank for collecting the bionic broths for enzyme production.

The disclosures in Italian Patent Application No. MI98A000093 from which this application claims priority are incorporated herein by reference.

What is claimed is:

1. A method for extracting oils from oleaginous plants or residues thereof, comprising a preliminary stage of enzyme kinetic analysis for determining the predominant polysaccharide component present in a respective oleaginous plant by investigating the amount of cellulose and/or pectin and/or starch and the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction.

2. A method for extracting oils from oleaginous plants or residues thereof comprising the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction, wherein said at least one enzyme is prepared locally by culturing on a nutrient substrate at least one microorganism suitable to produce said enzyme, selected from the group consisting of bacteria, fungi, hyphomycetes and mixtures thereof.

3. The method according to claim 2, wherein said microorganism is a sporogenous bacterium.

4. A method for extracting oils from oleaginous plants or residues thereof comprising the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction, wherein said at least one enzyme is an alpha-amylase obtained by culturing bacteria selected from the group consisting of *Bacillus cereus, Bacillus subtilis,* and mixtures thereof.

5. A method for extracting oils from oleaginous plants or residues thereof comprising the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction, wherein said at least one enzyme is an alpha-amylase obtained by culturing at least one microorganism selected from the group consisting of *Aspergillus foetidus, Aspergillus horizae, Cladosporium resinae, Cryptococcus luteoleus, Filobasidium capsoligenum, Lipomyces konoenkoae, Saccharomycopsis capsularis, Saccharomycopsis fibuligera, Schwanniomyces occidentalis,* and mixtures thereof.

6. A method for extracting oils from oleaginous plants or residues thereof comprising the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction, wherein said at least one enzyme is a pectin lyase obtained by culturing at least one microorganism selected from the group consisting of *Bacillus polymixa, Colletrichum lindemuthianum, Aspergillus japonicus, Monilinia fructigena, Penicillium expansum,* and mixtures thereof.

7. A method for extracting oils from oleaginous plants or residues thereof comprising the stages of subjecting the solid parts of said plants, which contain oils embedded in macromolecular polysaccharide substances typical of the integument of said plants, to an enzyme attack by means of at least one enzyme which lyses at least one said polysaccharide, and then recovering the oil from said solid parts by means of mechanical recovery stages without using solvent-based extraction, wherein the process wastewater produced after separation of the oil is subjected to at least one microbial fermentation to recover the solid residues of the polysaccharides subjected to enzyme attack and then to at least one second microbial fermentation in order to recover a solid biomass and conditioned water.

8. The method according to claim 7, wherein said biomasses and conditioned wastewater are recycled to the preparation of said nutrient substrate for said local production of said at least one enzyme.

9. The method according to claim 7, wherein said first and second fermentation are performed by means of an inoculum of *Saccharomyces cerevisiae* and *Candida utilis*, respectively.

10. The method according to claim 1, wherein said at least one enzyme is a pectin lyase obtained by culturing at least one microorganism selected from the group consisting of *Bacillus polymixa, Colletrichum lindemuthianum, Aspergillus japonicus, Monilinia fructigena, Penicillium expansum,* and mixtures thereof.

11. The method according to claim 1, wherein the process wastewater produced after separation of the oil is subjected to at least one microbial fermentation to recover the solid residues of the polysaccharides subjected to enzyme attack and then to at least one second microbial fermentation in order to recover a solid biomass and conditioned water.

12. The method according to claim 11, wherein said biomasses and conditioned wastewater are recycled to the preparation of said nutrient substrate for said local production of said at least one enzyme.

13. The method according to claim 11, wherein said first and second fermentation are performed by means of an inoculum of *Saccharomyces cerevisiae* and *Candida utilis,* respectively.

* * * * *